United States Patent [19]

Petit

[11] 4,286,129

[45] Aug. 25, 1981

[54] KEYBOARD HAVING SUDDEN TRIP TACTILE EFFECT KEYS

[75] Inventor: Julien Petit, Paris, France

[73] Assignee: Orega Electronique et Mecanique, France

[21] Appl. No.: 96,007

[22] Filed: Nov. 20, 1979

[30] Foreign Application Priority Data

Nov. 24, 1978 [FR] France ..... 78 33291

[51] Int. Cl.[3] ..... H01H 21/40; H01H 13/22

[52] U.S. Cl. ..... 200/159 B; 200/67 R

[58] Field of Search ..... 200/5 R, 5 A, 5 P, 5 E, 200/340, 159 R, 159 A, 159 B, 67 R, 67 DB

[56] References Cited

U.S. PATENT DOCUMENTS

| | | | |
|---|---|---|---|
| 3,728,509 | 4/1973 | Shimojo | 200/159 B |
| 3,898,421 | 8/1975 | Suzumura | 200/159 B |
| 3,908,109 | 9/1975 | Studebaker | 200/159 B |
| 3,932,722 | 1/1976 | Obata et al. | 200/340 |
| 4,190,748 | 2/1980 | Langford | 200/159 B |
| 4,195,210 | 3/1980 | Punds et al. | 200/159 A |

FOREIGN PATENT DOCUMENTS

| | | | |
|---|---|---|---|
| 2284177 | 4/1976 | France | 200/159 B |
| 2360979 | 3/1978 | France . | |
| 2378631 | 8/1978 | France . | |
| 2394166 | 1/1979 | France . | |

*Primary Examiner*—John W. Shepperd

[57] ABSTRACT

The invention relates to a keyboard having sudden trip tactile effect keys.

Such a keyboard comprises a flexible and conducting foil stamped with protuberances, each of them having a central upper flat part, with an area less than the area of the base of the protuberance, and a lateral part, connecting the central part to the base of the protuberance, and comprising or not substantially flat counter-shapes, which is deformed and touches a contact zone of a printed circuit placed therebelow, when a pressure is exerted on the central part.

These keyboards find applications in remote-control boxes or else in pocket calculating machines.

4 Claims, 4 Drawing Figures

FIG_1
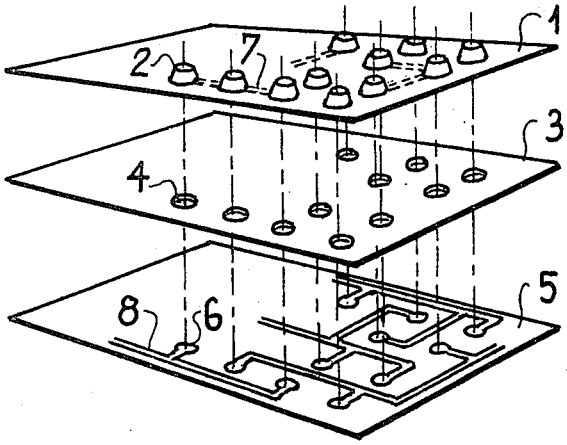
FIG_2-a
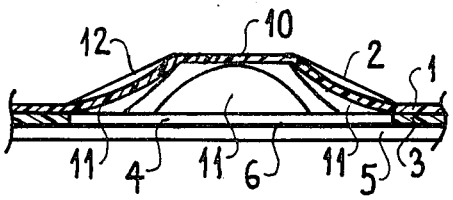
FIG_2-b
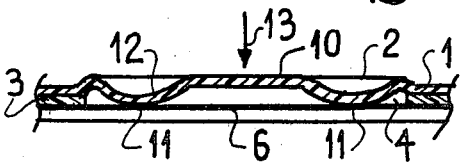
FIG_3
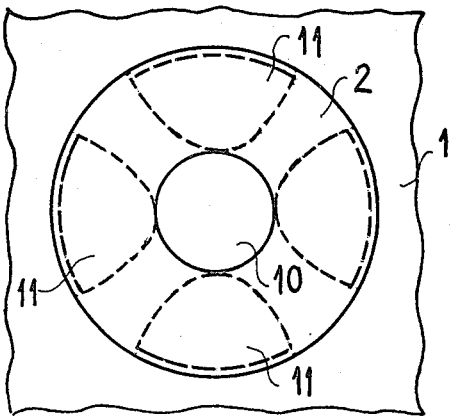

KEYBOARD HAVING SUDDEN TRIP TACTILE EFFECT KEYS

The present invention concerns keyboards having keys with a sudden trip tactile effect, thus giving the user the very distinct feeling of having established a contact, contrary to keyboards having touch contact keys.

It has first of all been proposed, in patents such as the U.S. Pat. No. 3,246,112 (Adams et al.) filed on Apr. 6, 1964 and granted on Apr. 12, 1966, to use keys made from polypropylene, formed from a cylindrical foot, and an upper convex dome-shaped part, covering the foot.

By applying a force, for example by means of a finger, to the center of the key thus formed, the dome is sharply deformed and assumes a concave shape. At the moment when this force ceases to be applied, the dome assumes again its initial shape.

This patent also proposes fastening to the inner surface of the dome of the key, a column, which when a force is applied to the center of the dome, transmits this force to a device forming an electric contactor, and thus establishes an electric contact.

Other patents, such as the U.S. Pat. No. 3,643,041 (Jackson) filed on Dec. 30, 1970 and granted on Feb. 15, 1972, then propose multi-key compact keyboards.

These keyboards comprise a flat metal foil deformed at several places, as many as the keys desired, by dome-shaped cavities having a circular base.

Under this first foil is placed another foil made from an insulating material and pierced with circular holes at positions corresponding to the domes. Furthermore, a printed circuit board provided with contacts is placed under this latter foil, the contacts being perpendicular to the centers of the domes and so to the centers of the circular holes.

In the rest position, the metal domes are not in electrical contact with the printed circuit, and there exists no electrical connection between the printed circuit board and foil provided with the domes.

If a force is applied to the center of one of the domes, it is suddenly deformed, passes from a convex shape to a concave shape, and comes into contact with the corresponding contactor of the printed circuit. On releasing this force, the dome again assumes its initial shape, and the contact ceases.

Thus, an electrical contact can be established between the metal foil and any contactor of the printed circuit.

So as to obtain the best results, this patent proposes using rather than a metal foil, a plastic foil whose inner surface is covered with a conducting deposit.

Other patents propose furthermore compact keyboards, used for example in pocket calculating machines, such as the U.S. Pat. No. 3,796,843 (Durkee et al.) filed on Jan. 2, 1973 and granted on Mar. 12, 1974. Therein there is described, for example keys having the shape of a dome whose base is in the shape of a square with rounded angles, or else a triangle with rounded angles.

In all these patents, the sudden trip tactile effect is obtained by the force passage from a convex surface to a concave surface, and the contact takes place in the center of this surface.

In the present state of the technique of keyboards having sudden trip tactile effect keys, the results obtained from a plastic foil, or from a material having the same qualities, covered on its inner surface with a conducting deposit, are among the most satisfactory.

However, it is noted in practice, that after a certain period of use (corresponding to some tens of thousands of operations), the deformation of the plastic due to forcibly passing from a convex surface to a concave surface, and the considerable pressure exerted on the key to obtain this forced passage, cause fairly considerable damage to the conducting deposit. In fact, cracks appear, and metal scales finish by working loose and falling onto the electrical circuits situated below the keys, cause in these circuits, troublesome short-circuits and operating defects.

Furthermore, with the contact taking place at a point located in the center of the key which is then concave in shape, there can be observed, on the one hand, a fairly troublesome rebound phenomenon and, on the other hand, the presence of a relatively high contact resistance.

The invention proposes eliminating these disadvantages, that is, on the one hand, removing the risks of crumbling of the conducting deposit and, on the other hand, reducing considerably the contact resistance and the rebound phenomena.

For this purpose, the keyboard having sudden trip tactile effect keys in accordance with the invention, comprises a flexible foil stamped with protuberances and conductive at least at the level of these protuberances, placed above a printed circuit board supporting conducting contact zones, perpendicular to the protuberances, and is characterized in that each protuberance of the flexible foil comprises, on the one hand, an upper central part which is preferably flat and whose area is less than the area of the base of the protuberance and, on the other hand, a lateral part connecting this central part to the base of the protuberance, which is deformed while giving the sensation of sudden tripping, and touches a corresponding contact zone on the printed circuit board, when a pressure is exerted on the central part, and assumes again its initial form when this pressure ceases.

Other characteristics of the invention will be clear from the following description given by way of non-limiting example and illustrated by the accompanying figures which represent:

FIG. 1, a schematic perspective view of the keyboard having keys in accordance with the invention.

FIG. 2*a*, a sectional view of a key of the keyboard according to the invention.

FIG. 2*b*, a sectional view of a depressed key of the keyboard according to the invention.

FIG. 3, a bottom view of a key of the keyboard according to the invention.

In FIG. 1 there can be seen a foil 1 made from a plastic material, flexible and resilient such as polyester, which is stamped with truncated cone-shaped or else truncated pyramid-shaped protuberances 2.

The lower surface of foil 1 may be entirely covered with a conducting material deposit, such as silver, or else in a preferred embodiment of the invention, only protuberances 2 have their inner face covered with this deposit, as well as some parts 7 of the lower face of foil 1 which ensure an electrical connection between the different protuberances.

Foil 1 may also be made from a conducting elastomer, or from any other material having equivalent conducting and plastic qualities.

A foil 3 of an insulating material, such as plastic material, is placed directly below foil 1 in contact with its lower surface. This foil is pierced with holes 4 having an area equivalent to the surface of the base of protuberances 2, each hole being placed under a corresponding protuberance.

A printed circuit board 5 is positioned under foil 3. The printed circuit 8, conducting, comprises contactor zone 6 placed directly under holes 4 of foil 3, each contact zone thus facing the inner surface of a protuberance of foil 1.

FIGS. 2*a* and 2*b* show a sectional view of a key of the keyboard according to the invention.

Protuberance 2 shown in FIG. 2*a* comprises an upper flat central part 10 and a substantially truncated cone-shaped lateral part 12 having counter-shapes 11 with substantially flat surfaces in relation to the conical surface of the protuberance. Each protuberance may also have a general shape equivalent on the whole to the shape of a truncated pyramid.

In a preferred embodiment of the invention, the protuberances are provided with four counter-shapes, but this number is in no way limiting. It is possible to have a greater or lesser number without it being prejudicial to the operation of the invention. In another embodiment of the invention, the protuberances have no counter-shape and the lateral part comes directly into contact with the printed circuit.

The inner surface of the protuberance is covered with a conducting deposit; in another embodiment of the invention, only surface 12, provided with its counter-shapes 11 or not, has its lower face covered.

Under foil 1 there is shown the insulating foil 3 pierced with a hole 4, the purpose of this foil being to insulate the conducting zones of foil 1 other than those of the protuberances, from the printed circuit of board 5. Only contact zone 6 may possibly touch the conducting zone of the protuberance.

Protuberance 2 is also shown in FIG. 3 in a bottom view with the same references as in the preceding figures. Protuberance 2 has its upper flat part 10 circular in shape as well as its base, and comprises substantially flat counter-shapes 11.

FIG. 2*b* shows a sectional view of a depressed key of the keyboard according to the invention.

In fact, if a thrust force 13 is exerted on the flat central part 10 of the protuberance, by means of a finger or a push-button not shown, the protuberance is depressed and the counter-shapes 11 come into contact with the contact zones of the printed circuit, thus establishing an electrical contact between the printed circuit and the conducting zone of foil 1, or else between two contacting zones placed side by side on the printed circuit and under the protuberance.

The counter-shapes 11 come then to bear on the contact zones of the printed circuit board with a pressure which depends on the rigidity of the material chosen for the protuberance and independent of the thrust force 13 contrary to the keys known in the prior art. In fact, in the prior art, it is the central part of the key, the part which receives the thrust force, which established the contact, whereas here according to the invention it is the lateral parts or the counter-shapes 11.

Since the central part of the key no longer passes from a convex shape to a concave shape, as was the case in the prior art, the risks of crumbling of the conducting deposit are very limited.

Furthermore, the multiplication of the contact points brings about a reduction in the contact resistance, a very considerable reduction in rebounding and so an increase in reliability.

The keyboard according to the invention has applications in the control boxes for audiovisual apparatus (radio, television, high fidelity), electrical household appliances, in remote-control boxes or else for the keyboards of pocket calculating machines.

I claim:

1. A keyboard device comprising a flexible foil having protuberances and being conductive at least under these protuberances, said flexible foil being placed above a printed circuit board having conducting contact zones at least below said protuberances, and wherein said protuberances of said flexible foil are made of two parts:

a central upper part which is approximately flat and parallel to said flexible foil;

and a lateral part connecting said central upper part to the base of the protuberance, said lateral part having an approximately frusto conical shape, the larger part of said cone being its base joining said flexible foil and said protuberance, and its smaller part being its upper part joining said lateral part and said central upper part, said frusto-conical lateral part comprising several counter-parts which produce hollowed shapes related to the conical surface of said lateral part;

said upper and lateral parts being so dimensioned that a pressure exerted on said upper part keeps it parallel to and separated from said flexible foil, but produces a sudden and reversible deformation of said lateral part so that said hollowed counter-parts touch corresponding contact zones on the printed circuit board.

2. A keyboard device according to claim 1, wherein the flexible foil with its protuberances is made of a thermoplastic material foil covered on its lower face, at least under said protuberances, with a conducting material deposit.

3. A keyboard device according to claim 2, wherein an insulating foil is placed between said flexible foil and said printed circuit board, said insulating foil being pierced with holes below said protuberances of said flexible foil.

4. A keyboard device according to any of claims 1 to 3, wherein the lateral part comprises four counter-parts symmetrically disposed around it.

* * * * *